US009801441B2

(12) United States Patent
Lai

(10) Patent No.: US 9,801,441 B2
(45) Date of Patent: Oct. 31, 2017

(54) BAG

(71) Applicant: Po-Chih Lai, Kaohsiung (TW)

(72) Inventor: Po-Chih Lai, Kaohsiung (TW)

( * ) Notice: Subject to any disclaimer, the term of this patent is extended or adjusted under 35 U.S.C. 154(b) by 0 days.

(21) Appl. No.: 15/435,968

(22) Filed: Feb. 17, 2017

(65) Prior Publication Data

US 2017/0251779 A1 Sep. 7, 2017

(30) Foreign Application Priority Data

Mar. 1, 2016 (TW) ..... 105202828 U

(51) Int. Cl.

| | |
|---|---|
| ***A45C 9/00*** | (2006.01) |
| ***A45C 1/02*** | (2006.01) |
| ***A45C 3/02*** | (2006.01) |
| ***A45C 3/04*** | (2006.01) |
| ***A45F 3/04*** | (2006.01) |
| ***A45F 4/02*** | (2006.01) |
| ***A45C 1/06*** | (2006.01) |

(52) U.S. Cl.

CPC ..... *A45C 9/00* (2013.01); *A45C 1/02* (2013.01); *A45C 1/06* (2013.01); *A45C 3/02* (2013.01); *A45C 3/04* (2013.01); *A45F 3/04* (2013.01); *A45F 4/02* (2013.01); *A45C 2009/007* (2013.01)

(58) Field of Classification Search

CPC .... A45C 9/00; A45C 1/02; A45C 1/06; A45C 3/02; A45C 3/04; A45C 2009/007; A45F 3/04; A45F 4/02

USPC ..... 224/581–583

See application file for complete search history.

(56) References Cited

U.S. PATENT DOCUMENTS

| | | | | | |
|---|---|---|---|---|---|
| 4,587,682 | A * | 5/1986 | Schultz | A47G 9/086 | 224/153 |
| 4,723,300 | A * | 2/1988 | Aranow | A45C 7/00 | 190/1 |
| 5,002,401 | A * | 3/1991 | Blackman | A45C 7/0095 | 150/112 |
| 5,337,933 | A * | 8/1994 | Nunez | A01K 97/06 | 224/577 |
| 5,544,792 | A * | 8/1996 | Arnwine | A45C 7/0086 | 224/153 |

(Continued)

*Primary Examiner* — Corey Skurdal

(74) *Attorney, Agent, or Firm* — Muncy, Geissler, Olds & Lowe, P.C.

(57) ABSTRACT

A bag, comprising a first bag body, a second bag body, a connecting portion, first and second combination portion, and first and second engaging portion. The connecting portion connected to the first side of the first bag body and the first side of the second bag body. The first combination portion formed on the second side of the first bag body. The second combination portion formed on the second side of the second bag body. A combination member of the second combination portion is detachably combined with a combination member of the first combination portion. The first engaging portion disposed on the connecting portion. The second engaging portion disposed on the first combination portion or the second combination portion. Wherein a first engaging member of the first engaging portion is detachably engaged with a first engaging member of the second engaging portion, and a second engaging member of the first engaging portion is detachably engaged with a second engaging member of the second engaging portion.

11 Claims, 5 Drawing Sheets

(56) References Cited

U.S. PATENT DOCUMENTS

| | | | | | |
|---|---|---|---|---|---|
| 5,743,649 | A * | 4/1998 | Gonzalez | A45C 3/00 | 383/39 |
| 5,797,529 | A * | 8/1998 | Lavine | A45C 7/0077 | 190/103 |
| 5,927,575 | A * | 7/1999 | Gatling | A01M 31/02 | 224/153 |
| 6,109,443 | A * | 8/2000 | Dercole | A45C 3/001 | 132/315 |
| 6,193,034 | B1 * | 2/2001 | Fournier | A45C 7/0095 | 190/107 |
| 6,334,519 | B1 * | 1/2002 | Tong | A45C 3/00 | 190/107 |
| 7,171,707 | B2 * | 2/2007 | Landay | A47G 9/086 | 190/2 |
| 2007/0028342 | A1 * | 2/2007 | Chan | A41D 13/04 | 2/48 |
| 2009/0114690 | A1 * | 5/2009 | Landay | A45C 7/0054 | 224/575 |

* cited by examiner

BAG

CROSS-REFERENCE TO RELATED APPLICATION

The present application claims benefit of priority to Taiwan Utility Patent Appl. No. 105202828, filed on Mar. 1, 2016, the entire disclosure of which is hereby incorporated by reference herein.

TECHNICAL FIELD

The present disclosure generally relates to a bag for accommodating objects.

BACKGROUND

In order to satisfy the need for people carrying or accommodating objects easily, the prior arts provide a wide variety of bags. According to the differences of usages or of the styles, the wide variety of bags can be roughly classified as a backpack with shoulder straps (such as a school bag or a sports backpack), a handbag with handles (such as a briefcase or a shopping bag), or a clutch bag without shoulder straps or handles (such as a wallet or a purse or a cosmetic bag), etc.

However, for different purposes of use, people always have different types of bags in order to meet the different needs of life and/or work. Correspondingly, the manufacturers designing and manufacturing bags will design and manufacture bags with different usages or structures based on users' different requirements in order to meet their needs.

However, it becomes bothersome to the users to have too many different types of bags instead. For example, if the users need to carry or accommodate different objects, they have to bring and carry a number of different bags, which is relatively inconvenient to use.

Therefore, there is an urgent need to provide a bag that can meet the users' different needs.

SUMMARY

In light of solving the foregoing problems of the conventional means, exemplary embodiments of the present inventive concept provides a bag, comprising: a first bag body having a first side and a second side opposed to the first side; a second bag body having a first side and a second side opposed to the first side; a connecting portion connected to the first side of the first bag body and the first side of the second bag body; a first combination portion formed on the second side of the first bag body and wherein the first combination portion has a combination member; a second combination portion formed on the second side of the second bag body and wherein the second combination portion has a combination member and wherein the combination member of the second combination portion is detachably combined with the combination member of the first combination portion; a first engaging portion disposed on the connecting portion, and the first engaging portion has a first engaging member and a second engaging member which are respectively disposed on the opposite sides of the connecting portion; and a second engaging portion disposed in or on the first combination portion or the second combination portion, and the second engaging portion has a first engaging member and a second engaging member which are respectively disposed on the opposite sides of the first combination portion or on the opposite sides of the second combination portion, wherein the first engaging member of the first engaging portion is detachably engaged with the first engaging member of the second engaging portion, and the second engaging member of the first engaging portion is detachably engaged with the second engaging member of the second engaging portion.

In an exemplary embodiment of the present inventive concept, the first bag body further has a third side and a fourth side opposed to the third side, the second bag body further has a third side and a fourth side opposed to the third side, and wherein each of the third side or the fourth side of the first bag body and the third side or the fourth side of the second bag body are provided with a first opening.

In an exemplary embodiment of the present inventive concept, said bag further comprises an opening and closing member mounted on the first opening to make the first opening openable and closable.

In an exemplary embodiment of the present inventive concept, said bag further comprises two handles, wherein the first bag body further has a first surface and a second surface, the second bag body further has a first surface and a second surface, and wherein the two handles are respectively disposed on the first surface of the first bag body and the first surface of the second bag body, or respectively disposed on the second surface of the first bag body and the second surface of the second bag body.

In an exemplary embodiment of the present inventive concept, said bag further comprises a shoulder strap, wherein the first bag body further has a first surface and a second surface, the second bag body further has a first surface and a second surface, and wherein the shoulder strap is disposed on the first surface of the first bag body or the first surface of the second bag body, or disposed on the second surface of the first bag body or the second surface of the second bag body.

In an exemplary embodiment of the present inventive concept, said bag further comprises a second opening, wherein the first bag body further has a first surface and a second surface, the second bag body further has a first surface and a second surface, and wherein the second opening is disposed on the first surface of the first bag body or the first surface of the second bag body, or disposed on the second surface of the first bag body or the second surface of the second bag body.

In an exemplary embodiment of the present inventive concept, said bag further comprises a third engaging portion and a fourth engaging portion, wherein the first bag body further has a first surface and a second surface, the second bag body further has a first surface and a second surface, and wherein the third engaging portion and the fourth engaging portion are respectively disposed on the first surface of the first bag body and the first surface of the second bag body, or respectively disposed on the second surface of the first bag body and the second surface of the second bag body.

In an exemplary embodiment of the present inventive concept, said bag further comprises a pocket, wherein the first bag body further has a first surface and a second surface, the second bag body further has a first surface and a second surface, and wherein the pocket is disposed on the first surface of the first bag body or the first surface of the second bag body, or disposed on the second surface of the first bag body or the second surface of the second bag body.

In an exemplary embodiment of the present inventive concept, the first combination portion or the second combination portion comprises an accommodation space therein, and wherein the second engaging portion is movably passing through the accommodation space of the first combination portion or the second combination portion.

In an exemplary embodiment of the present inventive concept, the connecting portion comprises an accommodation space therein.

In an exemplary embodiment of the present inventive concept, said bag further comprises a strap buckle, wherein the first bag body further has a first surface and a second surface, the second bag body further has a first surface and a second surface, and wherein the strap buckle is disposed on the first surface of the first bag body or the first surface of the second bag body, or disposed on the second surface of the first bag body or the second surface of the second bag body.

In comparison with the conventional means, the bag according to exemplary embodiments of the present inventive concept can be transformed into different carrying style by the users according to their actual needs. It is easy and convenient to transform the bag according to exemplary embodiments of the present inventive concept which can also accommodate diverse objects. Not only books and a lot of stuff, but also a laptop or even a skateboard can be accommodated in the bag of the present inventive concept. The present inventive concept provides a versatile bag.

DETAILED DESCRIPTION

Figure 1A:
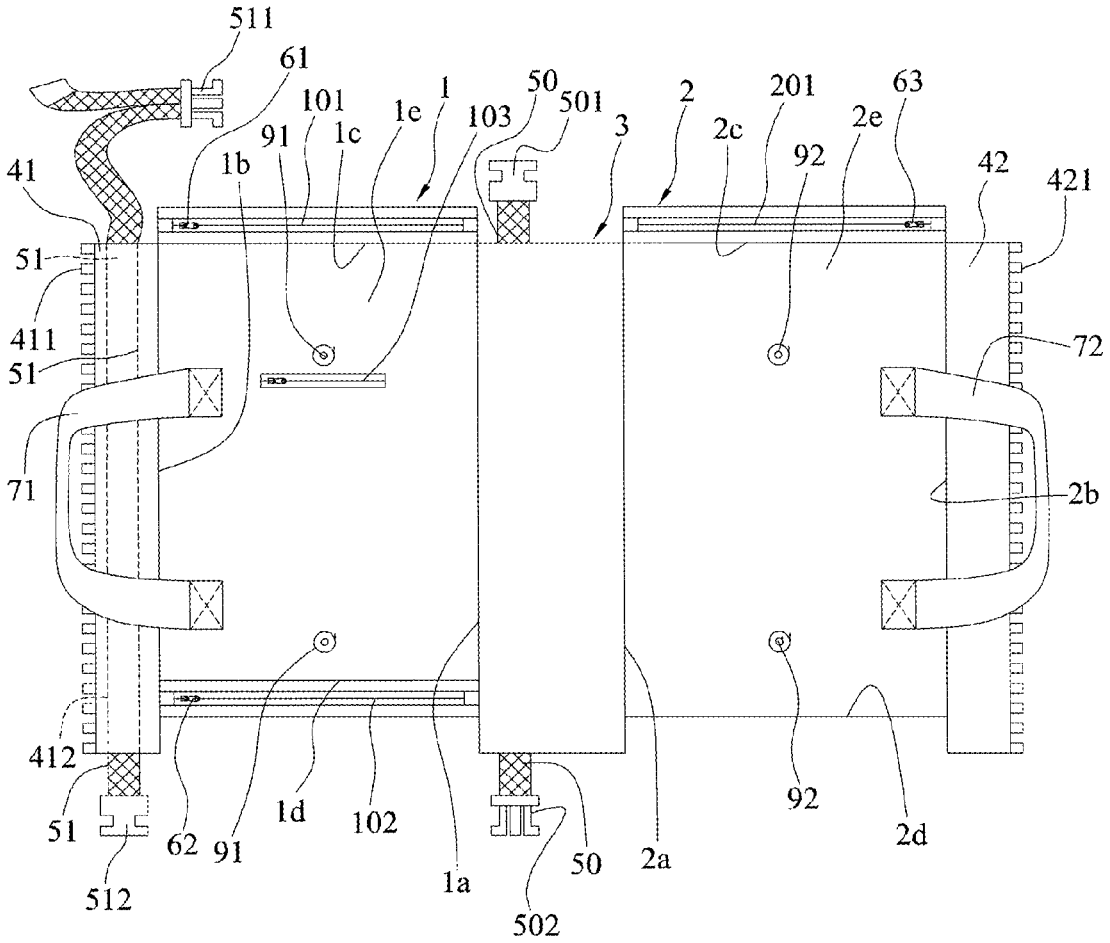
FIG. 1*a* illustrates a schematic view of one side of the bag according to exemplary embodiments of the present inventive concept in its expanded position.

The present inventive concept is described by the following specific exemplary embodiments. Those with ordinary skills in the arts can readily understand other advantages and functions of the present inventive concept after reading the disclosure of this specification.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein have to be defined based on the meaning of the terms together with the description throughout the specification.

It should be noted that the structures, ratios, sizes shown in the drawings appended to this specification are to be construed in conjunction with the disclosure of this specification in order to facilitate understanding of those skilled in the art. They are not meant, in any ways, to limit the implementations of present inventive concept, and therefore have no substantial technical meaning. Without affecting the effects created and objectives achieved by the present inventive concept, any modifications, changes or adjustments to the structures, ratio relationships or sizes, are to be construed as fall within the range covered by the technical contents disclosed herein. Meanwhile, terms, such as "on", "in", "at", "inner", "external", "one", "a" and the like, are for illustrative purposes only, and are not meant to limit the range implementable by the present inventive concept. Any changes or adjustments made to their relative relationships, without modifying the substantial technical contents, are also to be construed as within the range implementable by the present inventive concept. Also, when a part "includes" or "comprises" an element, unless there is a particular description contrary thereto, the part can further include other elements, not excluding the other elements.

Figure 1B:
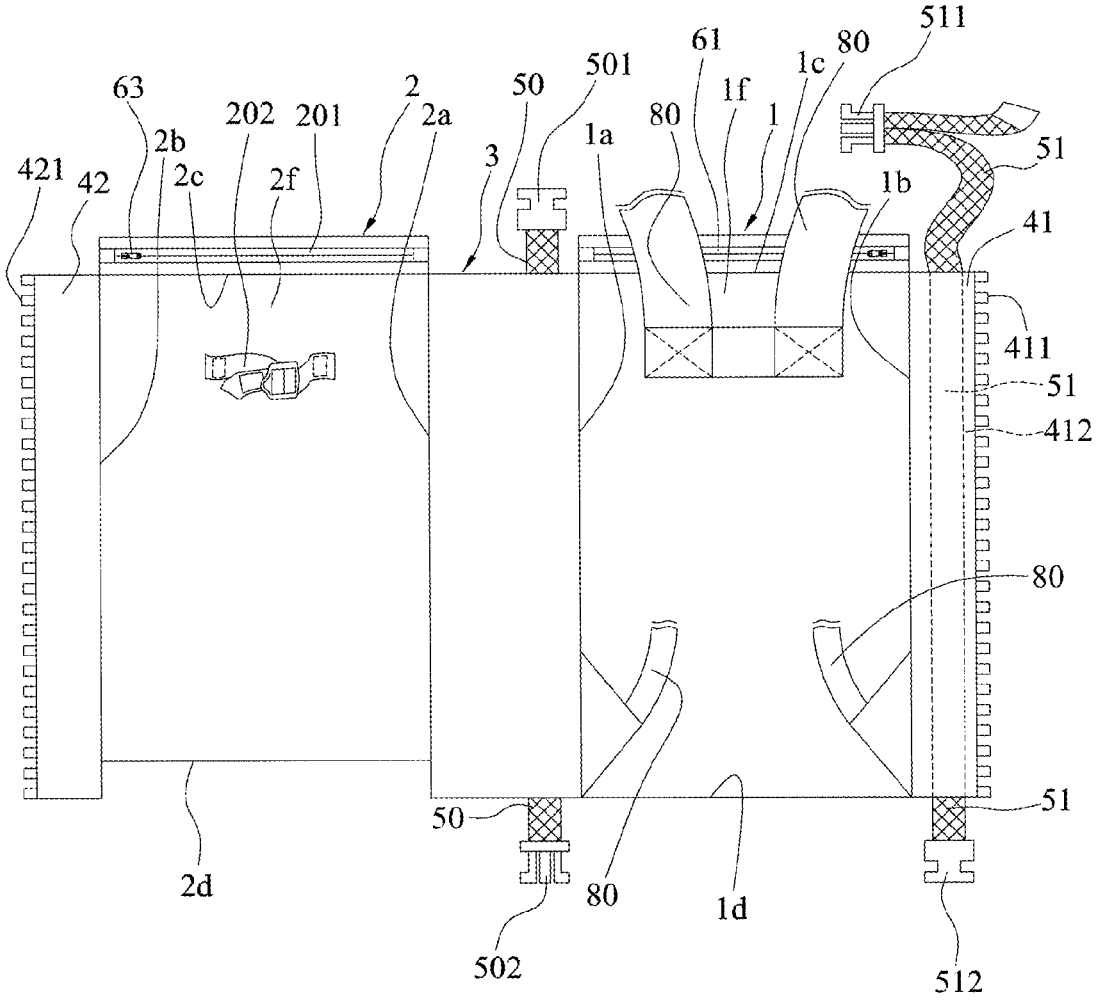
FIG. 1*b* illustrates a schematic view of the other side of the bag according to exemplary embodiments of the present inventive concept in its expanded position.

Refer to both FIG. 1*a* and FIG. 1*b*. FIG. 1*a* and FIG. 1*b* respectively illustrate the schematic views of two opposite sides of the bag according to exemplary embodiments of the present inventive concept in its expanded position. As shown in the figures, the bag according to exemplary embodiments of the present inventive concept comprises a first bag body 1 having a first side 1*a* and a second side 1*b* opposed to the first side 1*a*, a second bag body 2 having a first side 2*a* and a second side 2*b* opposed to the first side 2*a*, a connecting portion 3 connected to the first side 1*a* of the first bag body 1 and the first side 2*a* of the second bag body 2, a first combination portion 41 formed on the second side 1*b* of the first bag body 1 and wherein the first combination portion 41 has a combination member 411, a second combination portion 42 formed on the second side 2*b* of the second bag body 2 and wherein the second combination portion 42 has a combination member 421, and a first engaging portion 50 disposed on two opposite sides of the connecting portion 3 and the first combination portion 41 or the second combination portion 42 is equipped with a second engaging portion 51. The first engaging portion 50 can be a strap buckle with fixed length, and the second engaging portion 51 can be a strap buckle with adjustable length.

In one embodiment of the present inventive concept, the first combination portion 41 can comprise an accommodation space 412 therein to accommodate the second engaging portion 51. Accordingly, the second engaging portion 51 can be movably adjusted in the accommodation space 412, so that the users can move the second engaging portion 51 to adjust its length as required. In another embodiments, the accommodation space can be disposed in the second combination portion 42. Besides, the connecting portion 3 can comprise an accommodation space (not shown in the figures) therein, so that the length of the first engaging portion 50 disposed to the connecting portion 3 can be movably adjusted, too.

The first bag body 1 further has a third side 1*c* and a fourth side 1*d* opposed to the third side 1*c*, the second bag body 2 further has a third side 2*c* and a fourth side 2*d* opposed to the third side 2*c*, and wherein the third side 1*c* or the fourth side 1*d* of the first bag body 1 and the third side 2*c* or the fourth side 2*d* of the second bag body 2 are provided with a first opening 101, a second opening 102 and a third opening 201. Besides, the bag according to exemplary embodiments of the present inventive concept can further comprise opening and closing members 61, 62, 63, and the opening and closing members 61, 62, 63 can be zipper sets, each of which can comprise a pair of corresponding zipper teeth. The opening and closing members 61, 62, 63 are mounted on the first opening 101, the second opening 102 and the third opening 201 respectively, for the users to open or close the first opening 101, the second opening 102 and the third opening 201.

In an embodiment, the bag according to exemplary embodiments of the present inventive concept can further comprise two handles 71 and 72, wherein the first bag body 1 further has a first surface 1*e* and a second surface 1*f*, the second bag body 2 further has a first surface 2*e* and a second surface 2*f*. In this embodiment, the handles 71 and 72 are respectively disposed on the first surface 1*e* of the first bag body 1 and the first surface 2*e* of the second bag body 2. In another embodiment, the handles 71 and 72 can be respectively disposed on the second surface 1*f* of the first bag body 1 and the second surface 2*f* of the second bag body 2.

Figure 3A:
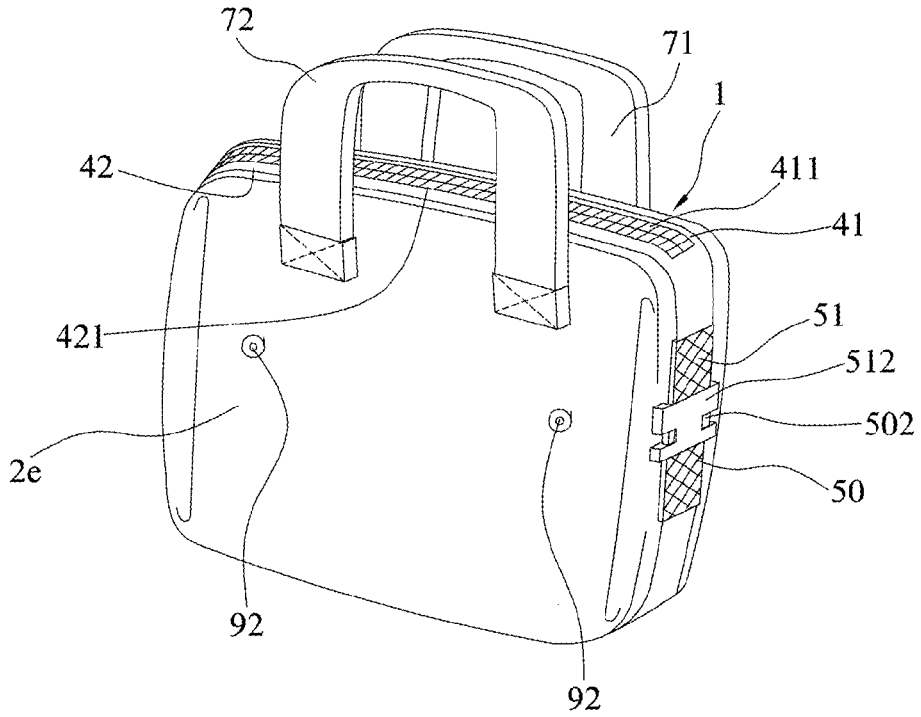
FIG. 3*a* illustrates a front view of the bag according to exemplary embodiments of the present inventive concept in the form of a handbag.
Figure 3B:
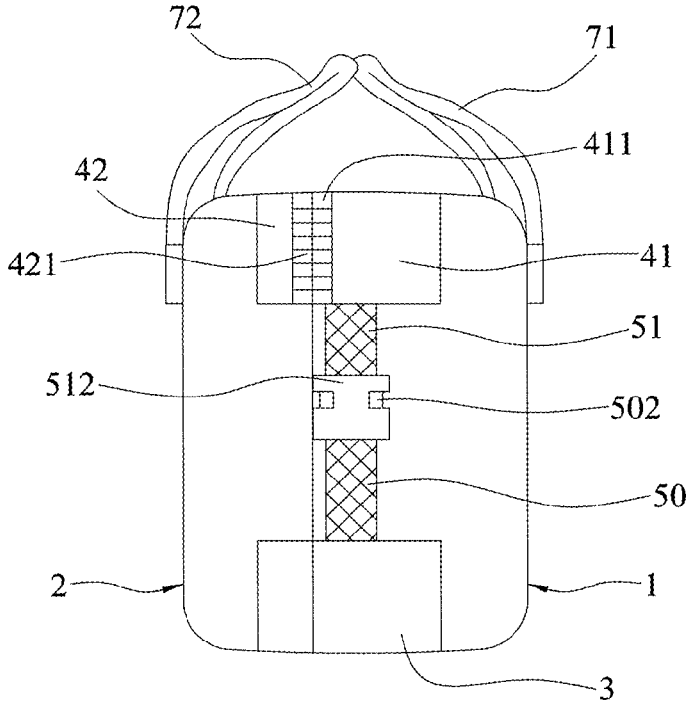
FIG. 3*b* illustrates a side view of the bag according to exemplary embodiments of the present inventive concept in the form of a handbag.

In this embodiment, the combination member 421 of the second combination portion 42 can be detachably combined with the combination member 411 of the first combination portion 41. In this embodiment, the combination members 411 and 421 can respectively be zipper teeth corresponding to each other, and together form a zipper set, so that the bag according to exemplary embodiments of the present inventive concept can be transformed into a handbag, as shown in FIG. 3*a* and FIG. 3*b*. In another embodiment, the combination members 411 and 421 can be, for example, but not limited to, hook and loop fastening system, e.g. Velcro hook and loop, or button and buttonholes or male and female button. More particularly, FIG. 3*a* illustrates a front view of the bag according to exemplary embodiments of the present inventive concept in the form of a handbag. FIG. 3*b* illustrates a side view of the bag according to exemplary embodiments of the present inventive concept in the form of a handbag. The first engaging portion 50 has a first engaging member 501 and a second engaging member 502 which are respectively disposed on the opposite sides thereof. The second engaging portion 51 has a first engaging member 511 and a second engaging member 512 which are respectively disposed on the opposite sides thereof. The first engaging members 501, 511 and the second engaging members 502, 512 can be male buckle straps and corresponding female buckle straps. When the bag is in the form of a handbag, the first engaging member 501 of the first engaging portion 50 is detachably engaged with the first engaging member 511 of the second engaging portion 51, and the second engaging member 502 of the first engaging portion 50 is detachably engaged with the second engaging member 512 of the second engaging portion 51. The users can carry the bag according to exemplary embodiments of the present inventive concept simply by grasping the handle 71 or 72. In another embodiment, the first engaging member 511 and the second engaging member 512, which are respectively disposed on the opposite sides of the second engaging portion 51 can be a male buckle and a female buckle which are able to buckle with each other, to form a side strap for the users to carry the bag on one side.

Besides, in an exemplary embodiment shown in FIG. 1*a* and FIG. 3*a*, two handles 71 and 72 can be disposed near the second side 1*b* of the first bag body 1 and the second side 2*b* of the second bag body 2, but not limited. The two handles 71 and 72 can also be disposed near the first side 1*a* of the first bag body 1 and the first side 2*a* of the second bag body 2. In this case, when the users carry the bag by grasping the handles, the zipper sets formed by combining the combination member 411 of the first combination portion 41 and combination member 421 of the second combination portion 42 will be facing down, and the connecting portion 3 will be facing up, which is more convenient to use for the users.

As shown in FIG. 1*a*, in another exemplary embodiment of the present inventive concept, the bag according to exemplary embodiments of the present inventive concept can further comprise a fourth opening 103. The fourth opening 103 can be disposed on the first surface 1*e* of the first bag body 1, to increase accommodation space for accommodating objects. In another embodiment, the fourth opening 103 can also be disposed on the first surface 2*e* of the second bag body 2, the second surface 1*f* of the first bag body 1 or the second surface 2*f* of the second bag body 2.

Figure 4A:
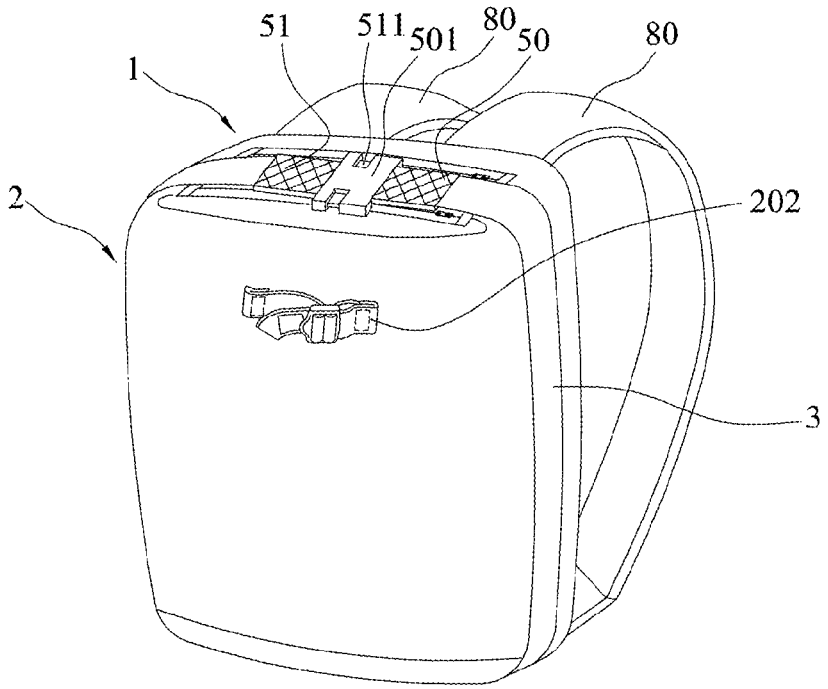
FIG. 4*a* illustrates a front view of the bag according to exemplary embodiments of the present inventive concept in the form of a backpack.

According to exemplary embodiments of the present inventive concept, the bag can further comprise a shoulder strap. Refer to FIG. 1*b*. As shown in the figure, the bag according to exemplary embodiments of the present inventive concept can further comprise shoulder straps 80. In this embodiment, the shoulder straps 80 can be disposed on the second surface 1*f* of the first bag body 1. Accordingly, when the first bag body 1 and the second bag body 2 are overlapped together by contacting the second surface 1*f* of the first bag body 1 and the second surface 2*f* of the second bag body 2, the bag according to exemplary embodiments of the present inventive concept presents as a form of a handbag, as shown in FIG. 3*a*. On the other hand, when the first bag body 1 and the second bag body 2 are overlapped together by contacting the first surface 1*e* of the first bag body 1 and the first surface 2*e* of the second bag body 2, the bag according to exemplary embodiments of the present inventive concept presents as the form of a backpack (which would be described in details later), as shown in FIG. 4*a*. However, whether the first bag body 1 and the second bag body 2 are overlapped by contacting the first surface 1*e* and the first surface 2*e* or by contacting the second surface 1*f* and the second surface 2*f*, the zipper sets formed by the combination member 411 of the first combination portion 41 and the combination member 421 of the second combination portion 42 have to be combined with each other to enable the bag according to exemplary embodiments of the present inventive concept to form a handbag or a backpack as a whole. In another embodiment, the shoulder straps 80 can also be disposed on the first surface 1*e* of the first bag body 1, the first surface 2*e* of the second bag body 2 or the second surface 2*f* of the second bag body 2. The means are indicated in the above description and it will not be necessary to repeat them herein.

Figure 2:
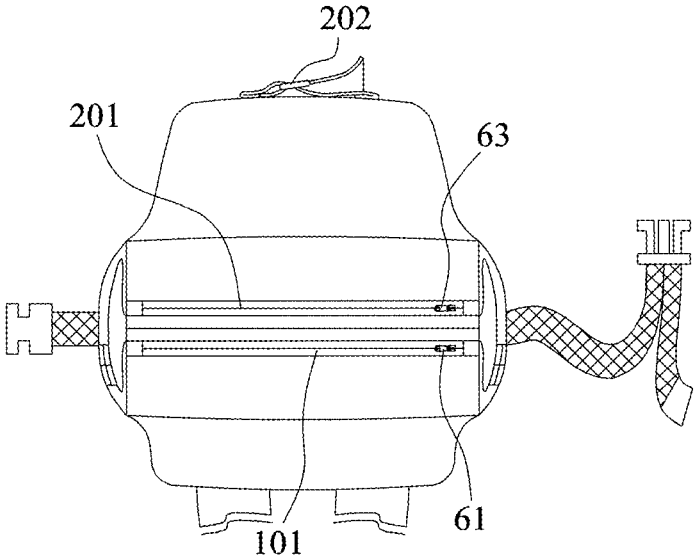
FIG. 2 illustrates a top view of the bag according to exemplary embodiments of the present inventive concept in the form of a backpack.
Figure 4B:
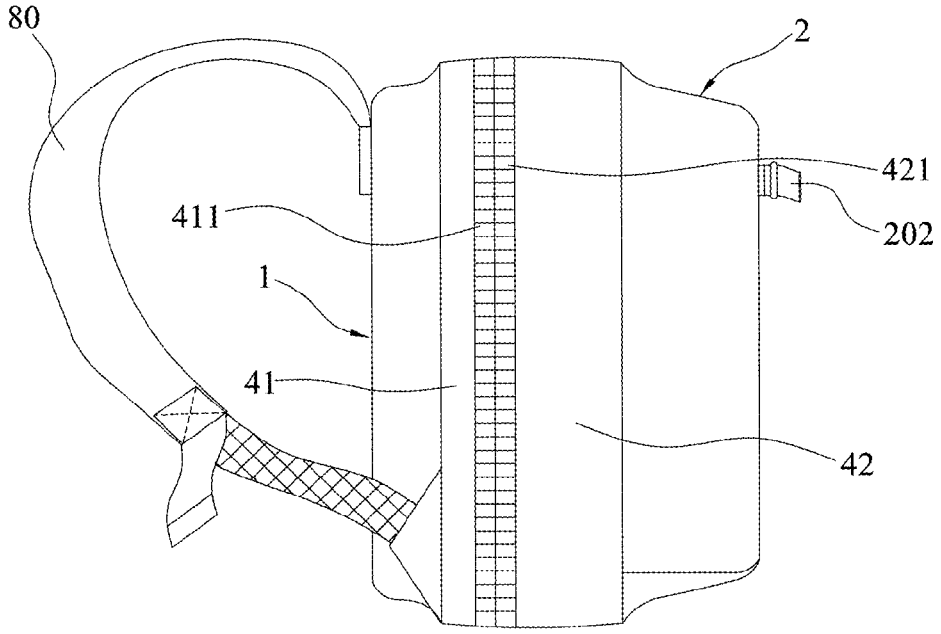
FIG. 4*b* illustrates a side view of the bag according to exemplary embodiments of the present inventive concept in the form of a backpack.

Refer to FIG. 2, FIG. 4*a* and FIG. 4*b*. FIG. 2 illustrates a top view of the bag according to exemplary embodiments of the present inventive concept in the form of a backpack. FIG. 4*a* illustrates a front view of the bag according to exemplary embodiments of the present inventive concept in the form of a backpack. FIG. 4*b* illustrates a side view of the bag according to exemplary embodiments of the present inventive concept in the form of a backpack. When the bag according to exemplary embodiments of the present inventive concept presents as the form of a backpack, the first engaging member 501 of the first engaging portion 50 is detachably engaged with the first engaging member 511 of the second engaging portion 51, and the second engaging member 502 of the first engaging portion 50 is detachably engaged with the second engaging member 512 of the second engaging portion 51 (referenced to FIG. 1*a*). The users can carry the bag according to exemplary embodiments of the present inventive concept on their back by the shoulder straps 80. Meanwhile, although the first bag body 1 and the second bag body 2 are combined by combining the first combination portion 41 and the second combination portion 42 when the bag presents as the form of a backpack, the first surface 1*e* and the first surface 2*e* are merely overlapped, and are not combined in a closely combined manner. In other words, there will be an open accommodation space formed between the overlapping first surface 1*e* and first surface 2*e*. This open accommodation space allows the users to put larger objects, such as skateboards or engineering blueprints therein.

In the embodiment of the present inventive concept as the form of a backpack, the bag according to exemplary embodiments of the present inventive concept can further comprise a third engaging portion 91 disposed on the first surface 1*e* of the first bag body 1 and a fourth engaging portion 92 disposed on the first surface 2*e* of the second bag body 2. Preferably, the third engaging portion 91 and the fourth engaging portion 92 can be a male button and a female button which are correspondingly engaged with each other. When the skateboard is placed in the open accommodation space between the first surface 1*e* and the first surface 2*e*, the third engaging portion 91 and the fourth engaging portion 92 can be engaged with each other to make the first surface 1*e* and the first surface 2*e* more close, thereby to fix the skateboard so that it is not easily dropped. In another embodiment, the third engaging portion 91 can be disposed on the second surface 1*f* of the first bag body 1 and the fourth engaging portion 92 can be disposed on the second surface 2*f* of the second bag body 2.

Moreover, in this embodiment, the bag can further comprise a pocket (not shown in the figures) disposed on the first surface 1*e* of the first bag body 1. The pocket provide the users with more accommodation space. In another embodiment, the pocket can be disposed on the second surface 1*f* of the first bag body 1, or the first surface 2*e* or the second surface 2*f* of the second bag body 2.

In this embodiment, the bag can further comprise a strap buckle 202 which can be disposed on the second surface 2*f* of the second bag body 2. The strap buckle 202 allows the users to insert objects such as a skateboard or rolled-up drawings therethrough and to adjust the length of the strap buckle 202 to tighten the object. It increases one more way for the users to carry objects. Alternatively, the handle of the trunk can also be passing through the strap buckle 202, so that the bag according to exemplary embodiments of the present inventive concept can be fixed on the trunk, which allows the users to easily carry them entirely.

In summary, the bag according to exemplary embodiments of the present inventive concept presents as the form of a handbag or a backpack depending on overlapping the first bag body and the second bag body in different direction. The users can carry the bag by carrying it on one side, carrying it on their back or grasping the handles thereof, depending on the object needed to be accommodated or the users' dress style.

The above embodiments are only used to illustrate the principles of the present inventive concept, and should not be construed as to limit the present inventive concept in any way. The above embodiments can be modified by those with ordinary skill in the art without departing from the scope of the present inventive concept as defined in the following appended claims.

I claim:

1. A bag, comprising:

a first bag body having a first side and a second side opposed to the first side;

a second bag body having a first side and a second side opposed to the first side;

a connecting portion connected to the first side of the first bag body and the first side of the second bag body;

a first combination portion formed on the second side of the first bag body and wherein the first combination portion has a combination member;

a second combination portion formed on the second side of the second bag body and wherein the second combination portion has a combination member and wherein the combination member of the second combination portion is detachably combined with the combination member of the first combination portion;

a first engaging portion disposed on the connecting portion, and the first engaging portion has a first engaging member and a second engaging member which are respectively disposed on the opposite sides of the connecting portion; and a second engaging portion disposed in or on the first combination portion or the second combination portion, and the second engaging portion has a first engaging member and a second engaging member which are respectively disposed on the opposite sides of the first combination portion or on the opposite sides of the second combination portion, wherein the first engaging member of the first engaging portion is detachably engaged with the first engaging member of the second engaging portion, and the second engaging member of the first engaging portion is detachably engaged with the second engaging member of the second engaging portion.

2. The bag of claim 1, wherein the first bag body further has a third side and a fourth side opposed to the third side, the second bag body further has a third side and a fourth side opposed to the third side, and wherein each of the third side or the fourth side of the first bag body and the third side or the fourth side of the second bag body are provided with a first opening.

3. The bag of claim 2, further comprising an opening and closing member mounted on the first opening for making the first opening openable and closable.

4. The bag of claim 1, further comprising two handles, wherein the first bag body further has a first surface and a second surface, the second bag body further has a first surface and a second surface, and wherein the two handles are respectively disposed on the first surface of the first bag body and the first surface of the second bag body, or respectively disposed on the second surface of the first bag body and the second surface of the second bag body.

5. The bag of claim 1, further comprising a shoulder strap, wherein the first bag body further has a first surface and a second surface, the second bag body further has a first surface and a second surface, and wherein the shoulder strap is disposed on the first surface of the first bag body or the first surface of the second bag body, or disposed on the second surface of the first bag body or the second surface of the second bag body.

6. The bag of claim 1, further comprising a second opening, wherein the first bag body further has a first surface and a second surface, the second bag body further has a first surface and a second surface, and wherein the second opening is disposed on the first surface of the first bag body or the first surface of the second bag body, or disposed on the second surface of the first bag body or the second surface of the second bag body.

7. The bag of claim 1, further comprising a third engaging portion and a fourth engaging portion, wherein the first bag body further has a first surface and a second surface, the second bag body further has a first surface and a second surface, and wherein the third engaging portion and the fourth engaging portion are respectively disposed on the first surface of the first bag body and the first surface of the second bag body, or respectively disposed on the second surface of the first bag body and the second surface of the second bag body.

8. The bag of claim 1, further comprising a pocket, wherein the first bag body further has a first surface and a second surface, the second bag body further has a first surface and a second surface, and wherein the pocket is disposed on the first surface of the first bag body or the first surface of the second bag body, or disposed on the second surface of the first bag body or the second surface of the second bag body.

9. The bag of claim 1, wherein the first combination portion or the second combination portion comprises an accommodation space therein, and wherein the second engaging portion is movably passing through the accommodation space of the first combination portion or the second combination portion.

10. The bag of claim 1, wherein the connecting portion comprises an accommodation space therein.

11. The bag of claim 1, further comprising a strap buckle, wherein the first bag body further has a first surface and a second surface, the second bag body further has a first surface and a second surface, and wherein the strap buckle is disposed on the first surface of the first bag body or the first surface of the second bag body, or disposed on the second surface of the first bag body or the second surface of the second bag body.

* * * * *